United States Patent [19]

McLain

[11] Patent Number: 4,545,285

[45] Date of Patent: Oct. 8, 1985

[54] MATCHED EXPANSION MUZZLE BRAKE

[76] Inventor: Clifford E. McLain, 7816 Manor House Dr., Fairfax Station, Va. 22039

[21] Appl. No.: 388,716

[22] Filed: Jun. 15, 1982

[51] Int. Cl.[4] ..... F41C 21/18

[52] U.S. Cl. ..... 89/14.3

[58] Field of Search ..... 89/14 B, 14 C, 14.2, 89/14.3

[56] References Cited

U.S. PATENT DOCUMENTS

| | | | |
|---|---|---|---|
| 858,745 | 7/1907 | McClean | 89/14 C |
| 1,605,393 | 11/1926 | Cutts, Jr. | 89/14.3 |
| 1,636,357 | 7/1927 | Cutts, Jr. | 89/14.3 |
| 2,191,484 | 2/1940 | Hughes | 89/14.3 |
| 2,212,685 | 8/1940 | Hughes | 89/14.3 |
| 3,155,003 | 11/1964 | Ruth | 89/14 |
| 3,808,943 | 5/1974 | Kelly | 89/14 C |

FOREIGN PATENT DOCUMENTS

| | | | |
|---|---|---|---|
| 633617 | 10/1963 | Belgium | 89/14 B |
| 2151378 | 4/1973 | Fed. Rep. of Germany | 89/14 C |
| 656608 | 5/1929 | France | 89/14 C |
| 2466 | of 1865 | United Kingdom | 89/14 C |

*Primary Examiner*—Stephen C. Bentley
*Attorney, Agent, or Firm*—Shlesinger Arkwright Garvey & Fado

[57] ABSTRACT

A matched expansion muzzle brake aligned with the forward end of a firearm barrel and bore including a tube having a through bore equal to and coincident with the barrel bore; outwardly diverging gas port means opening into said through bore; the gas port means including narrow throat means adjacent the opening into the through bore; and the narrow throat means having a cross-sectional area substantially equal to the cross-sectional area of the through bore.

12 Claims, 11 Drawing Figures

Fig. 1
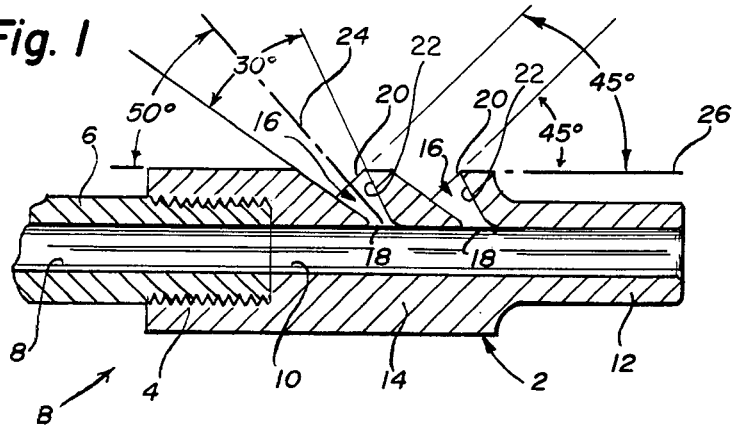
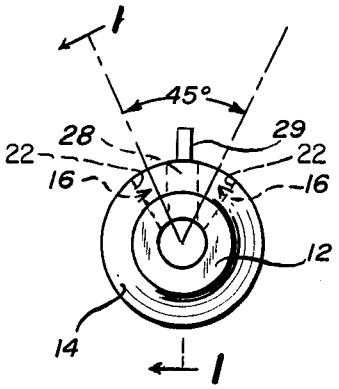
Fig. 2
Fig. 3
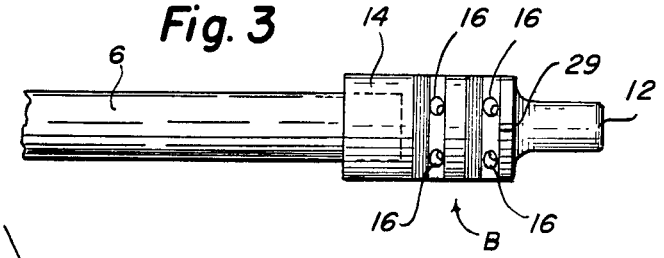
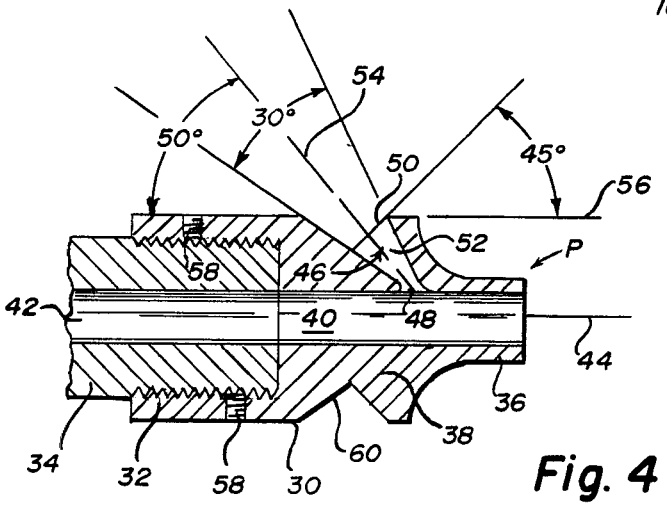
Fig. 4
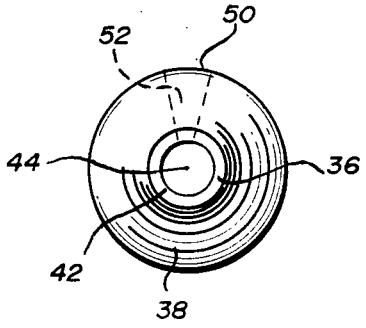
Fig. 5
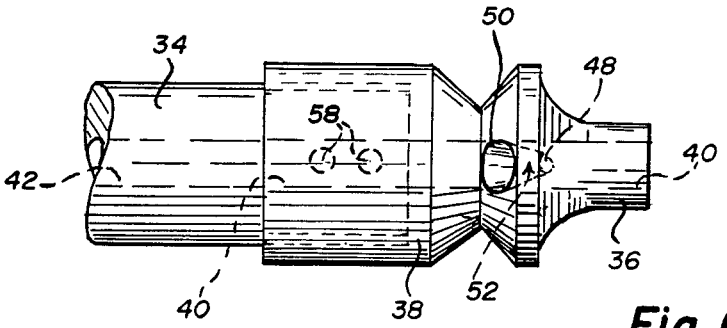
Fig. 6

MATCHED EXPANSION MUZZLE BRAKE

BACKGROUND AND FIELD OF THE INVENTION

This invention relates to recoil compensators attached to or integral with the muzzle of the barrel of firearms. More particularly, the present invention relates to handguns, rifles or automatic shoulder fired weapons where there is a need to reduce the recoil effect of firing such weapons, specifically the upward jump or climb of the muzzle of the barrel. This device uses a series of Laval nozzles to match the expansion of propellant gasses from the barrel to the atmosphere to achieve the maximum potential reactive thrust possible to counteract these recoil forces. A second important feature of the design is that the mass flow through the nozzle array be matched to the available propellant gas reservoir in the barrel. In a very rough way, this condition is met if the total throat area of the nozzle array does not exceed the barrel cross-sectional area.

Numerous muzzle attachment devices have been developed in the past to reduce the recoil effects of manual and automatic fire weapons; however, these devices have been found to be only marginally effective in reducing recoil. Many of these devices consist of straight holes or slots cut into the muzzle of the rifle or machine gun in an attempt to use the reactive force of the propellant gasses escaping upward to compensate for recoil forces causing muzzle climb (the most serious cause of loss of aiming accuracy or slowing the return to target for subsequent shots). Other types of recoil reduction devices use either the propellant gasses or mechanical linkage with the barrel and breech mechanism, or both, to provide for a slower absorption of the recoil forces by the shooter. These techniques, often realized in the basic design of the automatic loading mechanism of the firearm (as the M-1 Garand, for example), are effective in improving recoil control but do not reduce the total momentum imparted by the recoil forces. Instead, the recoil acceleration forces are reduced and prolonged (the integral remaining constant). Interest in recoil reduction, particularly in controlling muzzle climb during full automatic firing of military automatic rifles such as the M-16, has increased with the desire to obtain more effective direction of automatic small arms fire. In most lightweight M-14, AR-15, and M-16 tests only the first shot of the automatic burst provided a target hit in the tests quoted, whereas the M1918A2 [BAR] produced 80 percent hits in full automatic fire. The BAR is, of course, a heavy machine rifle whose mechanism and overall weight tends to compensate for recoil and muzzle climb forces. In Cutts U.S. Pat. Nos. 1,605,393 and 1,636,357, Ruth U.S. Pat. No. 3,155,003, and Hughes U.S. Pat. No. 2,212,685, the anticlimb devices have a central bore larger than the bore of the gun barrel and a series of straight, angular or flared ports extending inside the cylinder.

All of the above-cited devices attempt to use the reactive forces of the propellant gases escaping upward to compensate for the rearward and upward recoil forces. However, all of the prior art devices fail to match the area of the through narrows of the port means to the cross-sectional area of the bore and all of the prior art devices fail to provide a matched or optimum expansion of the propellant gases from the through bore to the atmosphere to provide maximum potential reactive thrust.

OBJECTS AND SUMMARY

It is, therefore, an object of the present invention to provide a recoil compensator for attachment to the muzzle of a gun barrel which through the use of a single gas port or series of gas ports will match the total area of the throat narrows expansion of the ports with the cross-sectional area of the bore.

It is another object of this invention to effectively reduce the muzzle climb and rearward recoil forces occurring from the firing of manual and automatic firearm weapons.

A further object of this invention is to provide a device which will effectively negate the effects of muzzle flash when firing the weapon.

An additional object of this invention is to provide a small arms recoil compensator having a unitary one piece design with no mechanical linkage or moving parts.

Yet a further object of this invention is to provide a device which is inexpensive to manufacture and requires minimum weight increase to the weapon.

Another object of this invention is to provide a muzzle brake which will not substantially effect the velocity of the projectile using a standard powder charge.

To summarize this invention, it relates to a device for attachment to or integral incorporation with the muzzle of the barrel of rifles or automatic shoulder fired weapons for reducing recoil effect, particularly muzzle climb.

These and other objects of this invention will be apparent from the following description and claims.

DESCRIPTION OF THE DRAWINGS

In the accompanying drawings which illustrate by way of example various embodiments of this invention:

FIG. 1 is a cross-sectional view of the preferred form of the present invention taken along the lines 1—1 of FIG. 2 and viewed in the direction of the arrows.

FIG. 2 is an end view of the invention.

FIG. 3 is a top plan view of FIGS. 1 and 2.

FIG. 4 is a cross-sectional view similar to FIG. 1 showing a modified form for attachment to a pistol.

FIG. 5 is an end view of the modified form of this invention shown in FIG. 4.

FIG. 6 is a top plan view of FIG. 5.

FIGS. 1 AND 2

Referring now to FIG. 1, the muzzle brake B is generally comprised of a horizontal body portion 2 threadedly attached at 4 to gun barrel muzzle 6. The through bore 10 of the muzzle brake is equal to and coincident with the gun barrel bore 8. The horizontal body portion 2 includes a main body portion 14 and a reduced front portion 12.

In FIG. 1, the gas orifices on ports 16 are in open communication with the through bore 10 at the entrances or narrow throats 18. The edges of the port 16 defining the entrances 18 are rounded to improve the flow into the gas orifices. Exits 20 are located at the upper ends of the gas ports 16. The surface area 22 between the entrances and exits of the gas port define the effective gas contact surfaces of generally conical or ellipsoidal continuously expanding outwardly configuration. Each gas port has a central axis 24 which is inclined rearwardly at an angle of about 50° from the horizontal axis 26 of the muzzle brake. The angle of divergence of the contact surfaces 22 do not exceed approximately 30°. The exits 20 of the gas ports 16 are inclined at an angle of about 45° from the horizontal axis 26 of the muzzle brake.

FIG. 2 shows the central axes 24 of the matched pairs of gas ports forming an angle between themselves of not less than about 45° from the through bore axis 27 in order to provide sufficient metal between ports 16 to prevent weakening of the web 28 between ports 16. A sight 29 may be provided as shown in FIGS. 2 and 3.

FIGS. 4 THROUGH 6

FIG. 4 shows a cross-sectional view of the pistol muzzle brake P, the horizontal body 30 is threadably attached along portion 32 to the muzzle of the pistol barrel 34. Body portion 30 includes a front portion 36 and a main body portion 38. A through bore 40 lies along the central axis 44 and is equal to and coincident with the pistol bore 42. A single gas port 46 is in open communication with the through bore 40 at entrance or narrow throat 48. The surface area defining the entrance 48 is rounded to improve the flow into the gas orifices. The gas port has an exit 50 at the upper end thereof. The surface area 52 within the boundaries of the exit and entrance is the effective gas contact surface area. The gas port 46 has a central axis 54 and is inclined rearwardly of the forward end of the barrel 34 from the vertical axis to about 50° from the horizontal axis 56. The gas port 46 is generally continuously divergent along this central axis 54 including any of a variety of continuously divergent shapes such as conical, paraboloidal, ellipsoidal or bell shaped. The angle of divergence of the gas port should not exceed about 30°. The exit 50 of the gas port 46 is inclined at an angle of about 45° from the horizontal axis 56. Set screws 58 secure the horizontal body 30 to the pistol barrel muzzle 34. A grooved neck portion 60 may extend circumferentially around the forward end of the main body portion 38.

FIGS. 7 THROUGH 9

FIGS. 7 through 9 illustrate an integral six port muzzle brake S incorporated in the gun barrel muzzle 62. The gun bore 64 is equal to and coincident with the through bore 68 of the muzzle brake S. The muzzle brake S has a main body portion 70 and a front portion 66. Three matched pairs of gas ports 72 are in open communication with the through bore 68 at entrances or narrow throats 74. The entrances 74 can be defined as the narrowest cross-sections of the throat portions adjacent to the opening in the through bore 68 following the round edge of each entrance 74, for reducing frictional flow.

Figure 9:
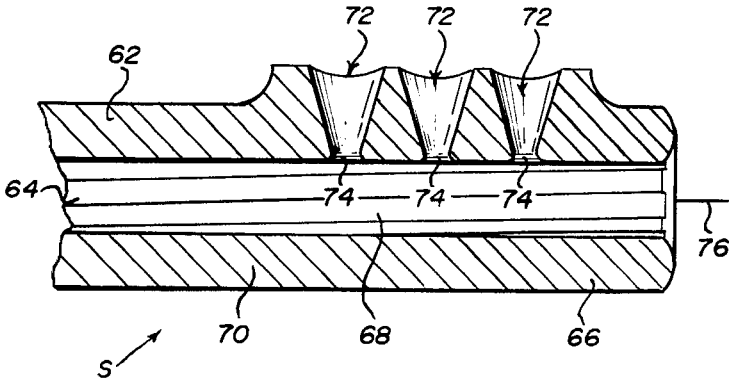
FIG. 9 is a cross-sectional view taken along the lines 9—9 of FIG. 8 and viewed in the direction of the arrows.

The gas ports 72 extend perpendicular from the through bore axis 76 terminating at the exits 78. The gas ports 72 are continuously divergent along their longitudinal axis and may be formed into any of a variety of divergent shapes as with the previous aforementioned embodiments. The angle of divergence formed between the walls of the gas port does not exceed approximately 30°. The effective gas contact surface area is defined as the total surface area lying between the entrances 74 and exits 78. The perpendicular alignment of the gas ports 72 with respect to the central bore axis 76 are illustrated in this six port embodiment. As best illustrated in FIG. 8, the angular displacement between the central axes 80 of the matched pairs of gas ports 72 does not exceed approximately 65°.

Figure 8:
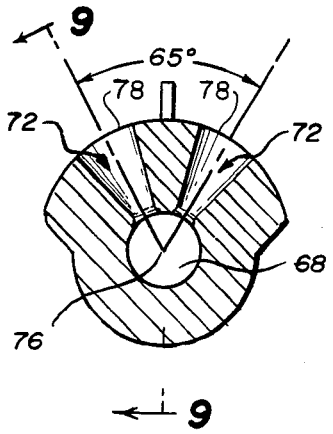
FIG. 8 is a cross-sectional view taken on lines 8—8 of FIG. 7 and viewed in the direction of the arrows.
Figure 7:
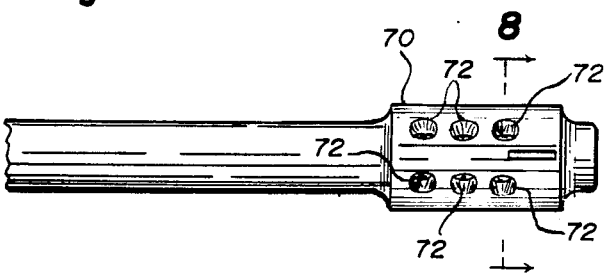
FIG. 7 is a top plan view of a modification of this invention.

Referring now to FIGS. 7 and 8, it can be seen that the radial distance from the center axis 76 of the through bore 68 to the exterior surface of the gun barrel 62 is less in immediate area than of the radial distance from the through bore axis 76 to the exterior surface of the gas ports 72. More specifically, this relates to the exit of the gas ports 78. As shown to advantage in FIG. 8, the distance from the through bore axis 76 to the exit 78 of the gas ports 72 is greater than the distance from the through bore axis 76 to the surface of the opposite side. Thus, the muzzle brake S in the area of the ports 72 contains more metal. This can be uniform circumferentially or machined away as in FIG. 8.

FIGS. 10 AND 11

Figure 10:
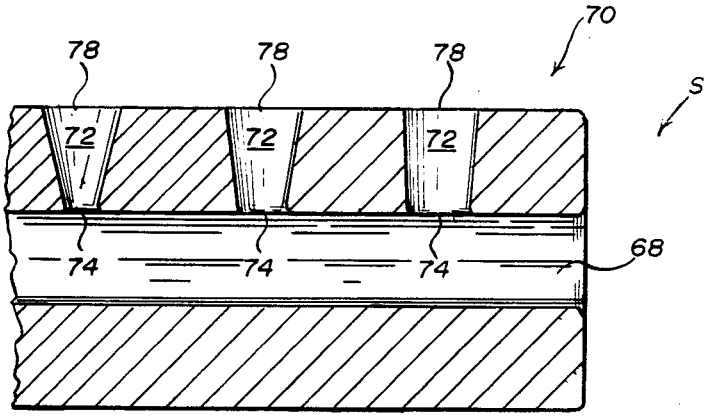
FIG. 10 is an enlarged sectional view showing an additional modification of the invention.
Figure 11:
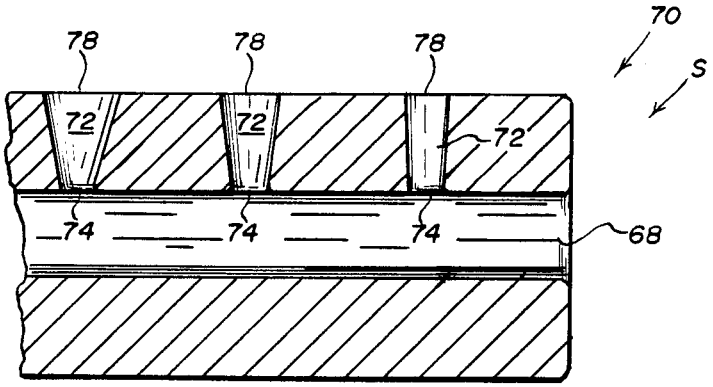
FIG. 11 is an enlarged sectional view showing an additional modification of the invention.

In FIGS. 10 and 11, the matched pairs of gas ports 72 include the above-mentioned entrances 74 along the bore 68 and exits 78. In FIG. 10, the gas port entrances 74 increase in cross-sectional surface area with each successive pair of gas ports 72 towards the front portion 66 of the muzzle brake S. The exits 78 remain constant. FIG. 11 illustrates an alternate form whereby the gas port entrances 74 remain constant along the length of the muzzle brake while the gas port exits 78 decrease in cross-sectional surface area with each successive gas port toward the front portion 66 of the muzzle brake S.

OPERATION

As previously stated, the gas ports 16, 46 and 72, whether single or plural, are of a continuously divergent shape. An optimum gas port size and shape is dependent upon the nature of the propellant used, the calibre of the weapon and ultimately the properties of the propellant gases traveling down the barrel bore. By matching the expansion of such propellant gases from the barrel bore to the atmosphere, a significant pressure drop from a high in the bore to a low through the gas ports occurs; optimum thrust is obtained and the recoil forces are counteracted. The design of the nozzles of the present invention are expressed as a ratio of expansion from the gas port entrance at the bore to the exit. The De Laval nozzle equation1/2/ (i.e., a real gas adiadactic expansion characteristic of all rocket engine designs) is used in the present invention to determine the ratio of expansion from the gas port entrance to the gas port exit. The area ratio for the matched expansion of a gas port from a "infinite" high pressure chamber is:

$$\frac{\text{GAS PORT AREA exit}}{\text{GAS PORT AREA entrance}} = \frac{A\ \text{exit}}{A\ \text{entrance}} = \frac{Ae}{At} = \frac{(P_e/P_c)^{1/k}}{\left(\frac{k+1}{2}\right)^{\frac{1}{k-1}}\left(\frac{k+1}{k-1}\left[1-\left(\frac{P_e}{P_c}\right)^{\frac{k-1}{k}}\right]\right)^{\frac{1}{2}}}$$

where; expansion to atmosphere $P_e = P_o = 1$ atmosphere.

1/This and the following equations are from: C. W. Besserer, *Missile Engineering Handbook*, Van Nostrand, 1958.

2/Bonney, Zucrow, & Besserer, *Aerodynamics, Propulsion, Structures*, Van Nostrand, 1956.

For nitro, ballistite, and cordite propellants where $C_p$ is the specific heat of the propellant gas at constant pressure and $C_v$ is the specific heat of the propellant gas at constant volume; supra 1/2/:

$$k = (C_p/C_v) = \text{approximately 1.28 to 1.31 average}$$

$P_c$ = chamber pressure, i.e., pressure in the through bore.

For the 7.65 mm NATO round, the chamber pressure $P_c$ = approximately 3,500 psi in a twenty-four inch barrel when the bullet is within 2 inches of the muzzle exit ($P_c$ is essentially constant over this final time period prior to the bullet exit from the barrel).

Under the above conditions, the expansion ratio required $A_e/A_t = 13.4$. The calculated thrust coefficient $C_f$ for this design is:

$$C_f = \lambda\, C_d\, \psi\, \Omega \left( \frac{2k}{k-1} \left[ 1 - \left( \frac{P_e}{P_c} \right)^{\frac{k-1}{k}} \right] \right)^{\frac{1}{2}}$$

For propellant gases: $\lambda$, $C_d$, $\psi \approx 1$; $\Omega = 0.668$.

$C_f = 1.64$ for the matched expansion nozzle $C_f = 1.0$ for a straight, non-expanded nozzle.

For a six port expansion nozzle brake, and throat diameter of each port of 0.10 inch, the thrust would be $$F = C_f\, P_c\, A_{entrance} \text{ (definition of } C_f)$$

$$= 44 \text{ lbs}_{force}$$

From a simple straight port of the same diameter throat the thrust would be: 27 $\text{lbs}_{force}$, but only if in each case the total throat area is approximately matched to the bore area.

The ratio of expansion is generally, for most small single and automatic fire weapons between a range of 10/1 through 20/1. However, ideally this range falls within 10/1 through 15/1.

A further feature of the present invention is to provide a combined entrance area of all the gas ports such that the mass flow of the propellant gases flowing through the gas ports is matched to that available from the barrel bore. Ideally, the total entrance area of all the gas ports is approximately equal to the cross-sectional area of the barrel bore. The matching of the gas port entrance volume to the barrel cross-sectional volume prevents the propellant gases from bleeding off too fast and reducing the effective thrust. In terms of surface area of the gas ports, the total effective gas contact surface areas 22, 52 and 72 are approximately eight to fifteen times the cross-sectional area of the through bore.

As previously mentioned, the angle of divergence of the gas ports does not exceed an angle of approximately 30°. The maximum angle is closely related to the effective gas contact surface area; that is, the actual area of the gas port means which restricts and comes in contact with the propellant gases. The gas port angle of divergence, which is within the 30° limitation, insures that the propellant gases do not lose contact with the effective gas contact surface areas of the port walls which insures that optimum thrust will be obtained and aids in reducing and preventing flash.

The rearwardly inclined central axis 24 of the gas port means 16 as shown in FIG. 1 and the rearwardly inclined central axis 54 of gas port 46 of FIG. 4 additionally compensate for the rearward recoil thrust when firing the weapon.

The bore and six port embodiments as best shown in FIGS. 2 and 8 illustrate the angular displacement between the axis of the pairs of gas ports at a maximum of 65° and a minimum of 45°. This displacement efficiently vents the propellant gases towards either side of the gun sight.

It is to be noted that for the various modifications of this invention, varying the length of the through bore beyond the end of the last port, can be used to control recoil and climb characteristics.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

I claim:

1. A matched expansion muzzle brake aligned with the forward end of a firearm barrel and bore including:

(a) a tube having a uniform diameter through bore equal to and coincident with said barrel bore;

(b) a plurality of outwardly diverging gas ports opening into said through bore;

(c) said gas ports each including narrow throat means adjacent said opening into said through bore;

(d) the combined entrance area of all of said narrow throat means having a cross sectional area substantially equal to the cross-sectional area of said through bore so that the mass flow of the propellant gases flowing through said gas ports is substantially matched to that available through said barrel bore;

(e) said gas ports including entrance means and exit means and said gas ports entrance means each having their openings in said uniform diameter through bore;

(f) said gas port entrance means and said gas port exit means having their dimensions determined by the following De Laval formula:

$$\frac{\text{GAS PORT AREA exit}}{\text{GAS PORT AREA entrance}} = \frac{A \text{ exit}}{A \text{ entrance}} = \frac{Ae}{At} = \frac{(P_c/P_e)^{1/k}}{\left(\frac{k+1}{2}\right)^{\frac{1}{k-1}} \left( \frac{k+1}{k-1} \left[ 1 - \left( \frac{P_e}{P_c} \right)^{\frac{k-1}{k}} \right] \right)^{\frac{1}{2}}}$$

where expansion to atmosphere $P_e = P_o = 1$ atmosphere for nitro, ballistite, and cordite propellants $k = C_p/C_v$ = approximately 1.28–1.31

$P_c$ = chamber pressure $C_p$ = specific heat of the propellant gas at constant pressure $C_v$=specific heat of the propellant gas at constant volume; and, (g) the combined total effective gas contact surface areas of said gas ports being approximately eight to fifteen times the cross-sectional area of said through bore.

2. A matched expansion muzzle brake as in claim 1 and wherein:

(a) the rake of expansion is:

(A exit)/(A entrance)≈10/1 through 20/1.

3. A matched expansion muzzle brake as in claim 1 and wherein:

(a) the rate of expansion is:

(A exit)/(A entrance)≈10/1 through 15/1.

4. A matched expansion muzzle brake as in claim 1 and wherein:

(a) said entrances have a rounded edge.

5. A matched expansion muzzle brake as in claim 1 and wherein:

(a) said muzzle brake includes an upper external surface and a lower external surface and the distance from the center line of said bore to said upper external surface is greater than the distance from the center line of said bore to the lower external surface.

6. A matched expansion muzzle brake as in claim 1 and wherein:

(a) said exit means of said gas port means is inclined forwardly from said forward end of said barrel at an angle of about 45° from horizontal.

7. A matched expansion muzzle brake as in claim 1 and wherein:

(a) said gas port means flares outwardly; and (b) said gas port means has its maximum diverging angle along the plane of said barrel axis not exceeding about 30°.

8. A matched expansion muzzle brake as in claim 1 wherein:

(a) said plurality of said ports includes matched radially spaced pairs of said ports.

9. A matched expansion muzzle brake as in claim 8 and wherein:

(a) the angle formed by the axis of said matched pairs of said ports does not exceed about 65°.

10. A matched expansion muzzle brake as in claim 8 and wherein:

(a) the angle formed by the axis of said matched pairs of ports is not less than about 45°.

11. A matched expansion muzzle brake as in claim 1 and wherein:

(a) the areas of successive gas port entrance means along said tube bore are of increasing dimension toward said forward end of said barrel, and (b) the areas of said successive gas port exits along said tube bore are of constant dimension toward said forward end of said barrel.

12. A matched expansion muzzle brake as in claim 1 and wherein:

(a) the areas of successive gas port exit means along said tube bore are of decreasing dimension toward said forward end of said barrel, and (b) the areas of said successive gas port entrance means along said tube bore are of constant dimension toward said forward end of said barrel.

* * * * *